US007185497B2

(12) United States Patent
Dudebout et al.

(10) Patent No.: US 7,185,497 B2
(45) Date of Patent: Mar. 6, 2007

(54) RICH QUICK MIX COMBUSTION SYSTEM

(75) Inventors: Rodolphe Dudebout, Phoenix, AZ (US); Terrel E. Kuhn, Mesa, AZ (US); Paul R. Yankowich, Phoenix, AZ (US); Frank J. Zupanc, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 213 days.

(21) Appl. No.: 10/839,116

(22) Filed: May 4, 2004

(65) Prior Publication Data

US 2005/0247065 A1 Nov. 10, 2005

(51) Int. Cl.
*F23R 3/14* (2006.01)
*F23R 3/30* (2006.01)
*F23R 3/06* (2006.01)

(52) U.S. Cl. ..... 60/776; 60/737; 60/748

(58) Field of Classification Search ..... 60/737, 60/748, 732, 733, 776, 750; 239/399, 400, 239/401, 403, 405, 406
See application file for complete search history.

(56) References Cited

U.S. PATENT DOCUMENTS 3,930,369 A * 1/1976 Verdouw ..... 60/737
4,173,118 A * 11/1979 Kawaguchi ..... 60/733
4,198,815 A * 4/1980 Bobo et al. ..... 60/737
4,584,834 A * 4/1986 Koshoffer et al. ..... 60/737
4,589,260 A * 5/1986 Krockow ..... 60/737
5,353,599 A 10/1994 Johnson et al.
5,431,019 A * 7/1995 Myers et al. ..... 60/737
5,974,780 A * 11/1999 Santos ..... 60/775
5,996,351 A * 12/1999 Feitelberg et al. ..... 60/732
6,101,814 A 8/2000 Hoke et al.
6,240,731 B1 6/2001 Hoke et al.
6,253,538 B1 7/2001 Sampath et al.
6,279,323 B1 * 8/2001 Monty et al. ..... 60/752
6,286,300 B1 9/2001 Zelina et al.
6,415,594 B1 7/2002 Durbin et al.
6,427,446 B1 8/2002 Kraft et al.
6,474,070 B1 11/2002 Danis et al.
6,606,861 B2 8/2003 Snyder
6,708,498 B2 * 3/2004 Stickles et al. ..... 60/776
6,735,949 B1 * 5/2004 Haynes et al. ..... 60/746
7,013,649 B2 * 3/2006 Monty ..... 60/748

* cited by examiner

*Primary Examiner*—Ted Kim
(74) *Attorney, Agent, or Firm*—Ingrassia Fisher & Lorenz

(57) ABSTRACT

A premix chamber for a combustor of a gas turbine engine comprises a cylindrical chamber having a premix chamber wall, the cylindrical chamber having a chamber inlet end longitudinally separated from a chamber outlet end along a central axis, a chamber inlet plate in communication with the premix chamber wall at the chamber inlet end, the chamber inlet plate having a fuel nozzle inlet hole disposed through the chamber inlet plate, the chamber inlet plate further comprising a plurality of swirler passages disposed through the chamber inlet plate, and the chamber outlet end being open. A method of producing turbine gas is also disclosed.

15 Claims, 5 Drawing Sheets

RICH QUICK MIX COMBUSTION SYSTEM

BACKGROUND OF THE INVENTION

The present invention generally relates to an apparatus and method for a rich, quick mix combustion system that provides low levels of NOx, carbon monoxide, unburned hydrocarbons, and smoke. More specifically, the present invention relates to an apparatus and method for a rich, quick mix combustion system comprising a premixing chamber located upstream of a combustion chamber.

Gas turbine engines, such as those which may be used to power modern commercial aircraft, may include a compressor for pressurizing a supply of air, a combustor for burning a hydrocarbon fuel in the presence of the pressurized air, and a turbine for extracting energy from the resultant combustion gases. The combustor may include radially spaced apart inner and outer liners. The liners may define an annular combustion chamber that resides axially between the compressor and the turbine. Arrays of circumferentially distributed combustion air holes may penetrate each liner at multiple axial locations to admit combustion air into the combustion chamber. Fuel may be supplied to the combustion chamber by one or more fuel nozzles.

Combustion of the hydrocarbon fuel may produce a number of reaction products including oxides of nitrogen (NOx). NOx emissions are the subject of increasingly stringent controls by regulatory authorities. Accordingly, engine manufacturers strive to minimize NOx emissions.

A principal strategy for minimizing NOx emissions is referred to as a rich burn, quick quench, lean burn (RQL) combustion system. The RQL strategy recognizes that the conditions for NOx formation are most favorable at elevated combustion flame temperatures, i.e., when the fuel-air ratio is at or near a stoichiometric ratio. A combustor configured for RQL combustion may include three serially arranged combustion zones: a rich burn zone at the forward end of the combustor, a quench or dilution zone axially aft of the rich burn zone, and a lean burn zone axially aft of the quench zone.

During engine operation, a portion of the pressurized air discharged from the compressor may enter the rich burn zone of the combustion chamber. Concurrently, the fuel nozzle may introduce a stoichiometrically excessive quantity of fuel into the rich burn zone. The resulting stoichiometrically rich fuel-air mixture may be ignited and burned to partially release the energy content of the fuel. The fuel rich character of the mixture may inhibit NOx formation in the rich burn zone by suppressing the combustion flame temperature. This condition may also resist blowout of the combustion flame during any abrupt reduction in engine power.

The fuel rich combustion products generated in the rich burn zone then enter the quench zone where the combustion process continues. Jets of pressurized air from the compressor may enter the combustion chamber radially through combustion air holes. The air mixes with the combustion products entering the quench zone to support further combustion and release additional energy from the fuel. The air may also progressively consume fuel in the fuel rich combustion products as they flow axially through the quench zone and mix with the air to produce a lean combustion product. Initially, the fuel-air ratio of the combustion products may change from fuel rich to stoichiometric, which may cause an attendant rise in the combustion flame temperature. Since the quantity of NOx produced in a given time interval increases exponentially with flame temperature, substantial quantities of NOx can be produced during the initial quench process. As the quenching continues, the fuel-air ratio of the combustion products changes from stoichiometric to fuel lean, causing an attendant reduction in the flame temperature. However, until the mixture is diluted to a fuel-air ratio substantially lower than stoichiometric, the flame temperature remains high enough to generate considerable quantities of NOx.

Finally, the lean combustion products from the quench zone flow axially into the lean burn zone where the combustion process concludes. Additional jets of compressor discharge air may be admitted radially into the lean burn zone. The additional air supports ongoing combustion to release energy from the fuel and regulates the peak temperature and spatial temperature profile of the combustion products. Regulation of the peak temperature and temperature profile may also protect the turbine from exposure to excessive temperatures and excessive temperature gradients.

Because most of the NOx emissions originate during the quenching process, it may be beneficial for the quenching to progress rapidly, thus limiting the time available for NOx formation. It may also be beneficial for the fuel and air to become intimately intermixed, prior to, and throughout the combustion process, otherwise, even though the mixture flowing through the combustor may result in combustion products that may be stoichiometrically lean overall, the combustion products may include localized pockets where the fuel-air ratio is stoichiometrically rich. Because of the elevated fuel-air ratio, fuel rich pockets may burn hotter than the rest of the mixture, thereby promoting additional NOx formation and generating local "hot spots" or "hot streaks" that may damage the turbine.

Attempts directed to lowering NOx emissions in gas turbine exhaust include U.S. Pat. No. 6,606,861 to Snyder (Snyder), which is directed to a combustor for a gas turbine engine, which includes inner and outer liners with a row of dilution air holes penetrating through each liner. The row of holes in the outer liner comprise at least a set of large size, major outer holes and may also include a set of smaller size minor outer holes circumferentially intermediate neighboring pairs of the major outer holes. The row of holes in the inner liner include dilution air holes circumferentially offset from the major outer holes and may also include a set of minor holes circumferentially intermediate major inner holes. The major and minor holes admit respective major and minor jets of dilution air into the combustor. The distribution of major and minor holes and the corresponding major and minor dilution air jets helps to minimize NOx emissions and regulates the spatial temperature profile of the exhaust gases discharged from the combustor. The fuel nozzle (referred to in Snyder as a fuel injector) injects fuel directly into the combustion chamber. Each of the liners in Snyder includes a support shell, a forward heat shield, and an aft heat shield. Snyder may thus result in a complicated arrangement, wherein the heat shields may be cooled using film cooling holes that penetrate through each heat shield, and each shell may be cooled using impingement cooling holes that penetrate through each shell.

Another attempt directed to lowering NOx emissions in gas turbine exhaust includes U.S. Pat. No. 6,286,300 to Zelina et al. (Zelina), which is directed to an annular combustor having fuel preparation chambers mounted in the dome of the combustor. In Zelina, the fuel preparation chamber is defined within a wall disposed about a center axis, which extends from an inlet end of the fuel preparation chamber to an outlet end of the fuel preparation chamber longitudinally along the center axis. An air swirler and a fuel atomizer are mounted to an inlet plate attached to the inlet end of the fuel preparation chamber. The air swirler provides swirled air to the fuel preparation chamber, while the atomizer provides a fuel spray to the fuel preparation chamber. Downstream of the inlet end of the fuel preparation chamber is an outlet end having an inwardly extending conical wall, referred to in Zelina as a chimney. This chimney restricts flow out of the fuel preparation chamber, thus the chimney acts to compress the mixture of fuel and air as it exits the fuel preparation chamber at the outlet end.

Zelina is thus directed to a design involving a separate swirler being mounted to the inlet of the fuel preparation chamber. Zelina also requires a conical chimney wherein the fuel/air mixture must first be compressed prior to ignition of the fuel/air mixture. As can be seen, there is a need for providing a thoroughly mixed fuel and air mixture to a combustion chamber of a gas turbine utilizing a simple design, without adversely affecting or compromising engine performance.

SUMMARY OF THE INVENTION

In one aspect of the present invention, a premix chamber comprises a cylindrical chamber having a chamber inlet end longitudinally separated from a chamber outlet end along a central axis; a chamber inlet plate in communication with chamber inlet end, the chamber inlet plate further comprising a plurality of swirler passages disposed through the chamber inlet plate, and the chamber outlet end being open.

In another aspect of the present invention, a premix chamber comprises a cylindrical chamber having a premix chamber wall coaxially disposed about a central axis, the cylindrical chamber having a chamber inlet end longitudinally separated from a chamber outlet end along the central axis; a chamber inlet plate in communication with the premix chamber wall at the chamber inlet end, the chamber inlet plate further comprising a plurality of swirler passages disposed through the chamber inlet plate; and the chamber outlet end comprising a flair outlet opening expanding radially away from the central axis.

In yet another aspect of the present invention, a combustor for a gas turbine engine comprises a combustor inlet end longitudinally separated from a combustor outlet end along a combustor centerline, a premix chamber disposed at the combustor inlet end, the premix chamber in fluid communication with a primary combustion chamber, the primary combustion chamber in fluid communication with a secondary combustion chamber disposed at the combustor outlet end, the premix chamber comprising a cylindrical chamber having a premix chamber wall coaxially disposed about the combustor centerline, the cylindrical chamber having a chamber inlet end longitudinally separated from a chamber outlet end along the combustor centerline by a chamber length, a chamber inlet plate in communication with the premix chamber wall at the chamber inlet end, a fuel nozzle inlet hole disposed through the chamber inlet plate, a plurality of swirler passages disposed through the chamber inlet plate, a fuel nozzle engaged with the chamber inlet plate within the fuel nozzle inlet hole, the chamber outlet end comprising a flair outlet opening, the flair outlet opening expanding radially away from the combustor centerline into the primary combustion chamber, the primary combustion chamber comprising a combustor liner having a first frustoconical portion attached to a cylindrical portion, the cylindrical portion attached to a second frustoconical portion serially disposed along the combustor central axis, wherein a radius of the first frustoconical portion increases in an axial direction from the combustor inlet end to the combustor outlet end, wherein a radius of the cylindrical portion remains constant longitudinally along the combustor centerline, wherein a radius of the second frustoconical portion decreases in an axial direction along the combustor centerline from the combustor inlet end to the combustor outlet end, the secondary combustor being within the combustor liner, wherein a radius of the secondary combustor remains constant longitudinally along the combustor centerline, wherein the primary combustor comprises a frustoconical heat shield disposed between the first frustoconical portion and the combustor centerline, wherein the secondary combustor comprises a plurality of intermediate jets disposed through the combustor liner, wherein the secondary combustor comprises a plurality of dilution holes disposed through the combustor liner, and wherein the plurality of dilution holes are located between the intermediate jets, and the combustor outlet end.

In a further aspect of the present invention, a gas turbine engine comprises a compressor in operable communication with a combustor module, the combustor module in operable communication with a turbine module, the combustor module comprising a combustor inlet end longitudinally separated from a combustor outlet end along a combustor centerline, a premix chamber disposed at the combustor inlet end, the premix chamber in fluid communication with a primary combustion chamber, the primary combustion chamber in fluid communication with a secondary combustion chamber disposed at the combustor outlet end, the premix chamber comprising a cylindrical chamber having a premix chamber wall coaxially disposed about the combustor centerline, the cylindrical chamber having a chamber inlet end longitudinally separated from a chamber outlet end along the combustor centerline, the chamber inlet end comprising a chamber inlet plate in communication with the premix chamber wall, the chamber inlet plate having a fuel nozzle inlet hole disposed through the chamber inlet plate, the chamber inlet plate further comprising a plurality of swirler passages disposed through the chamber inlet plate, a fuel nozzle engaged with the chamber inlet plate within the fuel nozzle inlet hole, and the chamber outlet end being open.

In yet a further aspect of the present invention, a gas turbine engine comprises a compressor in operable communication with a combustor module, the combustor module in operable communication with a turbine module, the combustor module comprising a combustor inlet end longitudinally separated from a combustor outlet end along a combustor centerline, a premix chamber disposed at the combustor inlet end, the premix chamber in fluid communication with a primary combustion chamber, the primary combustion chamber in fluid communication with a secondary combustion chamber disposed at the combustor outlet end, the premix chamber comprising a cylindrical chamber having a premix chamber wall coaxially disposed about the combustor centerline, the cylindrical chamber having a chamber inlet end longitudinally separated from a chamber outlet end along the combustor centerline, the chamber inlet end comprising a chamber inlet plate in communication with the premix chamber wall, the chamber inlet plate having a fuel nozzle inlet hole disposed through the chamber inlet plate, the chamber inlet plate further comprising a plurality of swirler passages disposed through the chamber inlet plate, a fuel nozzle engaged with the chamber inlet plate within the fuel nozzle inlet hole, and the chamber outlet end comprising a flair outlet opening expanding radially away from the combustor centerline into the primary combustion chamber.

In still a further aspect of the present invention, a method to produce turbine gas from a combustor comprises atomizing a fuel into a premix chamber of the combustor along with a quantity of air; premixing the fuel with the air, wherein the fuel and the air are mixed within the premix chamber for a residence time to produce an air fuel mixture; performing a primary combusting step, wherein the air fuel mixture is combusted in a primary combustion chamber of the combustor to produce a partial combustion mixture; performing a secondary combusting step, wherein the partial combustion mixture is directed through a necked down portion of the primary combustion chamber into a secondary combustion chamber, wherein a plurality of intermediate jets provide secondary combustion air to produce exhaust gas, followed by diluting the exhaust gas, wherein dilution holes disposed through the secondary combustor provide dilution air, wherein the exhaust gas is diluted with the dilution air to produce turbine gas.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention generally provides a gas turbine having a combustion chamber comprising a premix chamber. The premix chamber comprises a cylindrical chamber having a chamber inlet end longitudinally separated from a chamber outlet end along a central axis (e.g., a combustor centerline). Directly upstream of, and in physical communication with, the chamber inlet end may be a chamber inlet plate through which may be disposed a fuel nozzle and a plurality of swirler passages. This is in contrast to the prior art, wherein a separate swirler is mounted to the chamber inlet plate.

Also, the premix chamber of the present invention may include an unrestricted chamber outlet end, or a chamber outlet end having a flared opening. This is also in contrast to the prior art, wherein the mixing chamber outlet is constricted prior to the combustion chamber.

The present invention may also include a premix chamber which opens into a first frustoconical portion of the combustion chamber which expands outward from a central axis. This portion of the combustion chamber may be the primary zone, which may be cylindrical in shape. Downstream (e.g., serially of the primary zone of the combustion chamber may be a second frustoconical region or portion which may be conically constricted inward via the second frustoconical portion into a necked down region. This design prevents hot gases from recirculating upstream towards the primary zone. This is in contrast to the prior art, wherein the combustion chamber is a convergent conical section at the exit plane.

Figure 1:
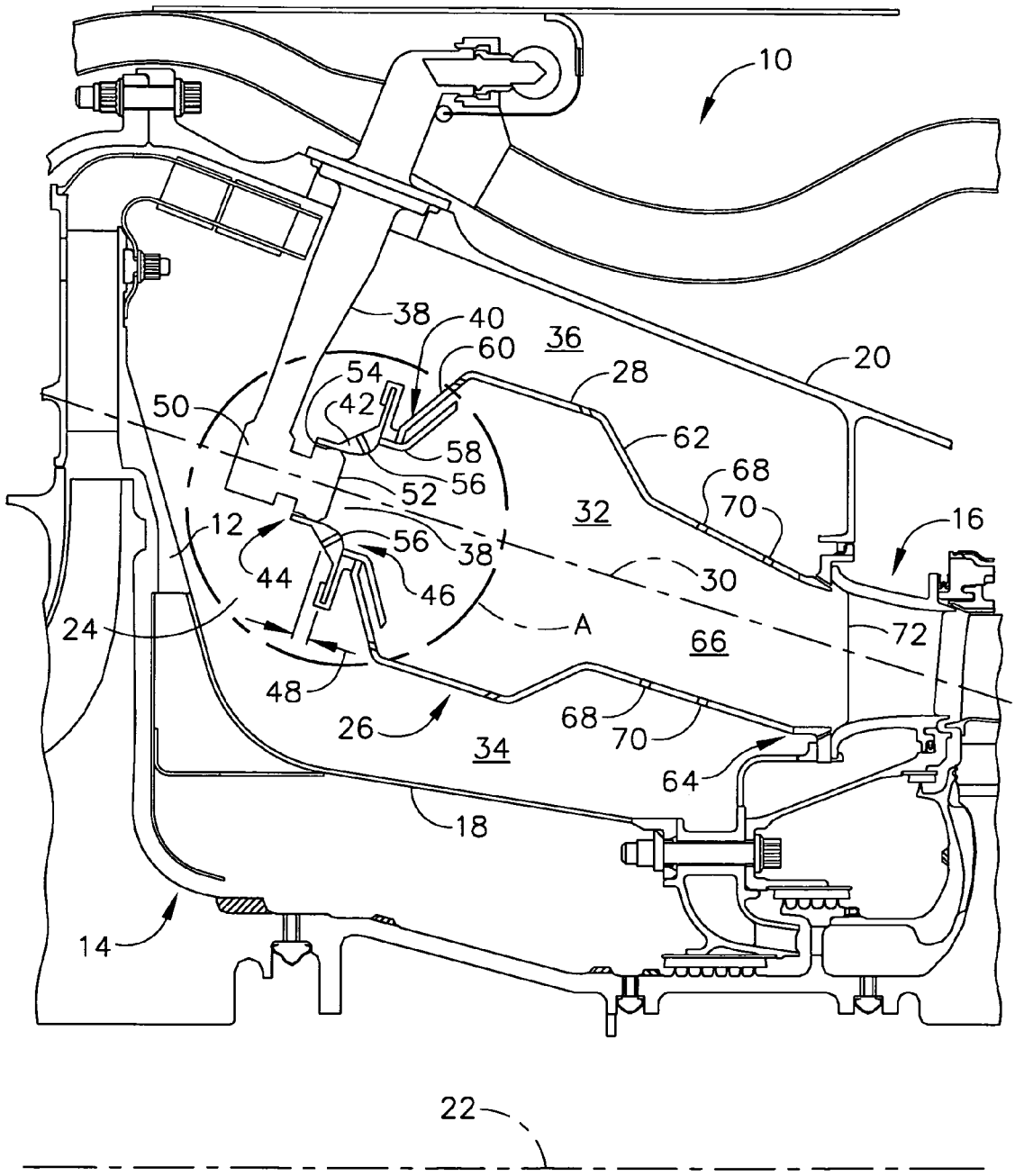
FIG. 1 is a cross-sectional view of a gas turbine engine including a combustor, according to the present invention.

In more specifically describing the present invention, FIG. 1 shows a cross-sectional view of a portion of a gas turbine engine, generally referred to as 10, according to an embodiment of the present invention. Gas turbine engine 10 may include a compressor (not shown), a diffuser 12 (partially shown), a combustor module 14, and a turbine module 16 (partially shown). The compressor may be in operable communication with combustor module 14, and combustor module 14 may be in operable communication with turbine module 16. Combustor module 14 may include a radially inner case 18 and a radially outer case 20, concentric with radially inner case 18. Radially inner case 18 and radially outer case 20 may circumscribe an axially extending engine centerline 22 to define an annular pressure vessel 24. Combustor module 14 may also include a combustor 26 residing within annular pressure vessel 24. Combustor 26 may include a combustor liner 28 that circumscribes a combustor centerline 30 to define an annularly shaped primary combustion chamber 32. Combustor liner 28 cooperates with radially inner case 18 and with radially outer case 20 to define inner air plenum 34, and outer air plenum 36, respectively.

A premix chamber 38 may be disposed at a combustor inlet end 40 of primary combustion chamber 32. Premix chamber 38 may be bound by a premix chamber wall 42 annularly (e.g., coaxially) disposed about combustor centerline 30. Premix chamber 38 may be in the form of a cylinder cylindrical chamber 49. Premix chamber 38 may include a chamber inlet plate 41 in physical communication with a chamber inlet end 44, longitudinally separated from a chamber outlet end 46 by a chamber length 48. Chamber length 48 may extend from chamber inlet plate 41 to combustor inlet end 40. Chamber outlet end 46 may be completely open and in fluid communication with primary combustion chamber 32. Chamber inlet plate 41 may include a fuel nozzle inlet hole 54, which may be coaxial with combustor centerline 30. Fuel nozzle inlet hole 54 may thus be dimensioned and arranged within chamber inlet end 40 such that a fuel nozzle 50 may be engaged within fuel nozzle inlet hole 54. Fuel nozzle 50 may also have a nozzle face 52 directed toward chamber outlet end 46.

Chamber inlet plate 41 may also include a plurality of swirler passages 56 disposed through chamber inlet plate 41. Chamber outlet end 46, may include a flair outlet opening 58, which may have a flared opening (e.g., opening radially away from combustor centerline 30).

Combustor 26 may include primary combustion chamber 32, which may comprise a first frustoconical dome portion 60 attached to a cylindrical portion 61 of combustor liner 28. Cylindrical portion 61 may be attached to a second frustoconical portion 62 (e.g., forming a necked down portion) serially disposed along combustor central axis 30. A radius of first frustoconical portion 60 may increase in an axial direction from combustor inlet end 40 to combustor outlet end 64. A radius of cylindrical portion 61 may remain constant longitudinally along combustor centerline 30. A radius of second frustoconical portion 62 may decrease radially along combustor centerline 30 from combustor inlet end 40 to combustor outlet end 64. Primary combustion chamber 32 may also include a frustoconical heat shield 80 disposed between first frustoconical portion 60 and combustor centerline 30.

Combustor 26 may further include a secondary combustion chamber 66 within combustor liner 28. A radius of secondary combustion chamber 66 may remain constant longitudinally along combustor centerline 30. Secondary combustion chamber 66 may comprise a plurality of intermediate jets 68 disposed through combustor liner 28. Secondary combustion chamber 66 may also comprise a plurality of dilution holes 70 disposed through combustor liner 28. In an embodiment, a plurality of dilution holes 70 may be located between intermediate jets 68 and combustor outlet end 64. Intermediate jets 68 and dilution holes 70 may be capable of adding air from inner air plenum 34 and from outer air plenum 36 into secondary combustion chamber 66. Combustor 26 then empties into turbine module 16 through combustor exit plane 72.

Figure 2:
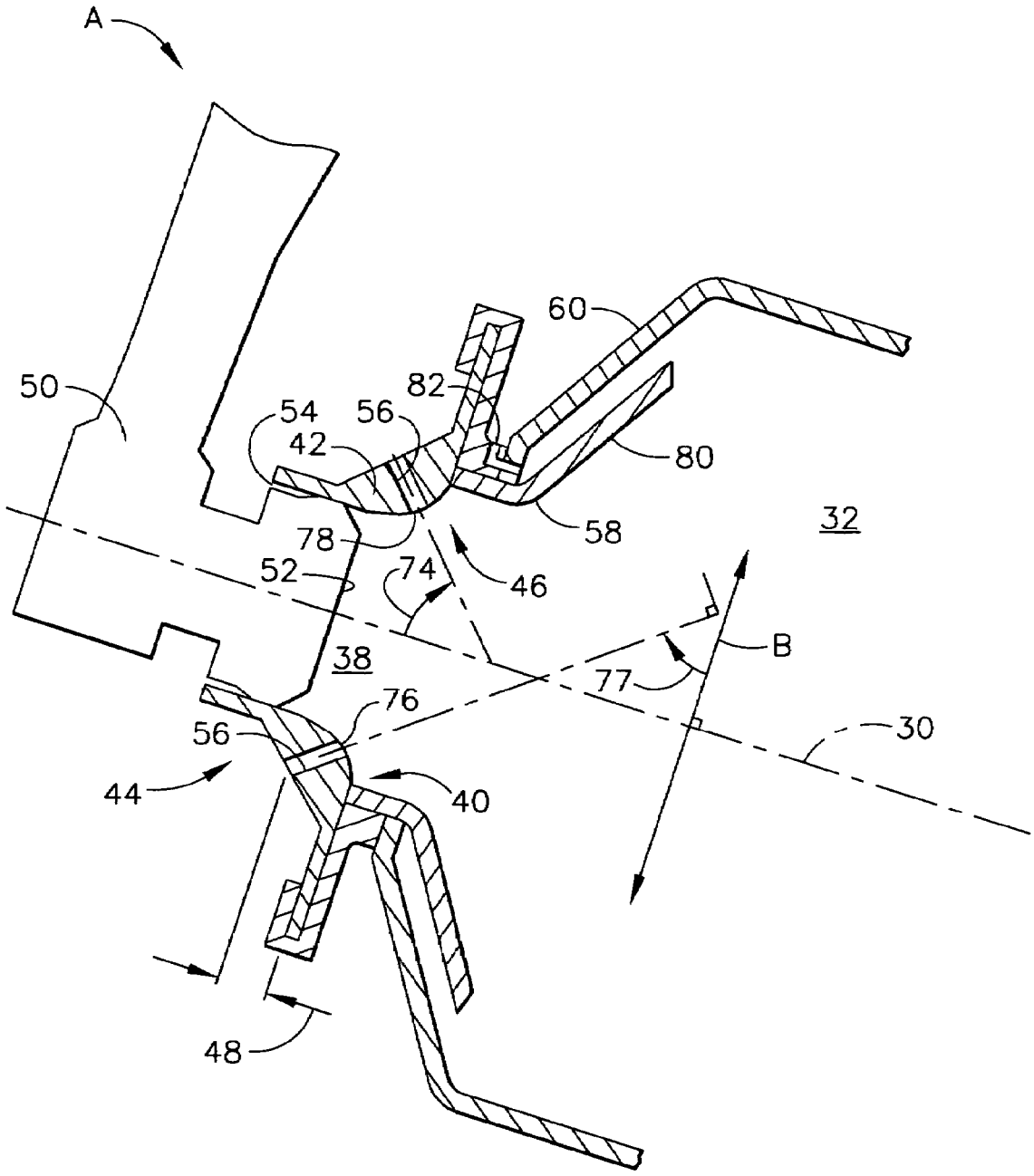
FIG. 2 is an enlarged view of portion A of FIG. 1.

Referring now to FIG. 2, which shows an enlarged cross-sectional view of portion A of FIG. 1, in which chamber inlet end 44 is shown in detail. In the embodiment shown in FIGS. 1 and 2, fuel nozzle 50 may be engaged by chamber inlet end 44 through fuel nozzle inlet hole 54. Premix chamber 38 may be bound by premix chamber wall 42 annularly disposed about combustor centerline 30.

Chamber length 48 may extend from chamber inlet plate 41 to chamber outlet end 46. Chamber length 48 may be varied, for example, depending on the residence time within premix chamber 38 desired for a particular application. In an embodiment, chamber length 48 may be about 0.2 inches to about 1 inch, with 0.4 inches to about 0.7 inches used in another embodiment. In yet another embodiment, chamber length may be about 0.5 inches to about 0.6 inches.

A ratio of chamber length 48 to a chamber diameter 49 (i.e., chamber length 48 divided by chamber diameter 49) may be about 0.2 to about 0.6, with 0.3 to about 0.5 used in another embodiment. In yet another embodiment, the ratio of chamber length 48 to chamber diameter 49 may be about 0.4 to about 0.45.

Again with reference to FIG. 2, chamber inlet plate 41 may include a fuel nozzle inlet hole 54, which may be centered about combustor centerline 30. Swirler passages 56 may be disposed radially about combustor centerline 30, and about fuel nozzle inlet hole 54. Swirler passages 56 may be arranged within chamber inlet plate 41 to be at a swirler inlet angle 74 with combustor centerline 30. In an embodiment, swirler inlet angle 74 may be about 30° to about 90° longitudinal to combustor centerline 30. In still another embodiment, swirler inlet angle 74 may be about 45° to about 75° longitudinal to combustor centerline 30, with a swirler inlet angle 74 of about 50° to about 60° longitudinal to combustor centerline 30 being useful in still another embodiment. In addition, swirler passages 56 may also include a cantilever portion 76 at a cantilever angle 77 determined normal to combustor centerline 30 (i.e., disposed perpendicular to combustor centerline 30). In an embodiment, cantilever angle 77 may be about 25° to about 45° relative to line B disposed normal to combustor centerline 30. In an alternative embodiment, cantilever angle 77 may be about 35° to about 40° relative to line B disposed normal to combustor centerline 30.

In the embodiment shown in FIG. 2, nozzle face 52, which may be in communication with premix chamber 38, may be recessed to one or more swirler passage outlets 78 of swirler passages 56. Swirler passage outlets 78 may be disposed uniformly about combustor centerline 30, or may be non-uniformly disposed, both radially and longitudinally about combustor centerline 30. Swirler passages 56 may also be uniformly disposed radially about combustor centerline 30 (i.e., a central axis), between fuel nozzle inlet hole 54, and premix chamber wall 42.

Fuel nozzle 50 may include a single- or multiple stage fuel atomizer. In an embodiment, fuel nozzle 50 may be an air-blast fuel nozzle.

Chamber outlet end 46 may protrude into primary combustion chamber 32 through a flair outlet opening 58 which opens outward from combustor centerline 30. As shown in FIG. 2, combustor dome 60 may be protected by a dome heat shield 80, which may be frustoconical in shape, corresponding to the shape of combustor dome 60. Dome heat shield 80 may be cooled by film cooling via dome heat shield cooling passage 82 that may be disposed through premix chamber wall 42 and/or through chamber inlet plate 41. In an embodiment, dome heat shield cooling passage 82, may be disposed through, and arranged within, chamber inlet plate 41 such that an external environment (e.g., inner air plenum 34, outer air plenum 36) may be in fluid communication with dome heat shield 80 through a conduit 102 (see FIG. 4) between premix chamber wall 42 and dome heat shield 80. Combustor dome 60 may be cooled by impingement cooling through combustor dome 60.

Figure 3:
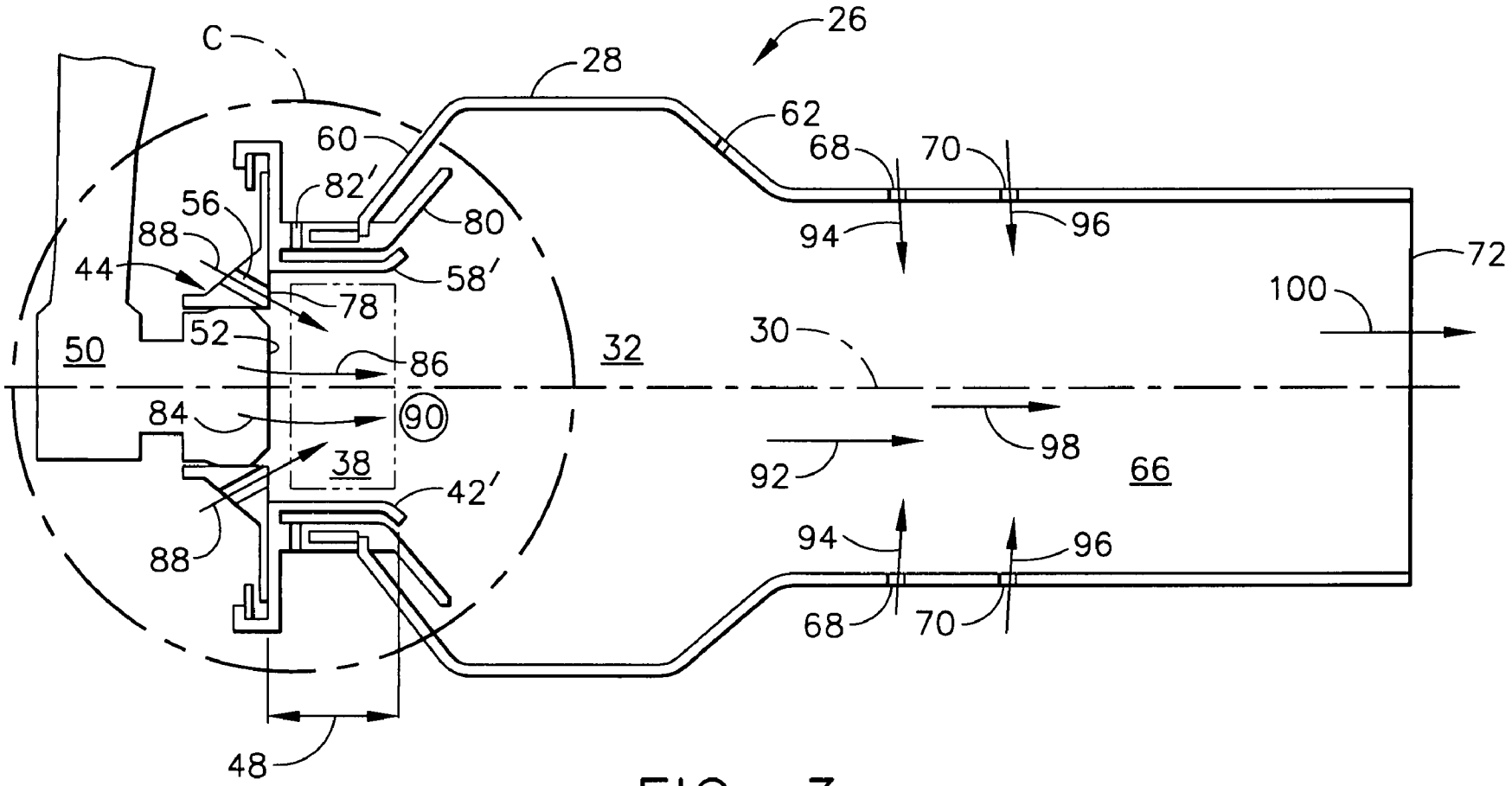
FIG. 3 is a cross-sectional view of a combustor, according to the present invention.
Figure 4:
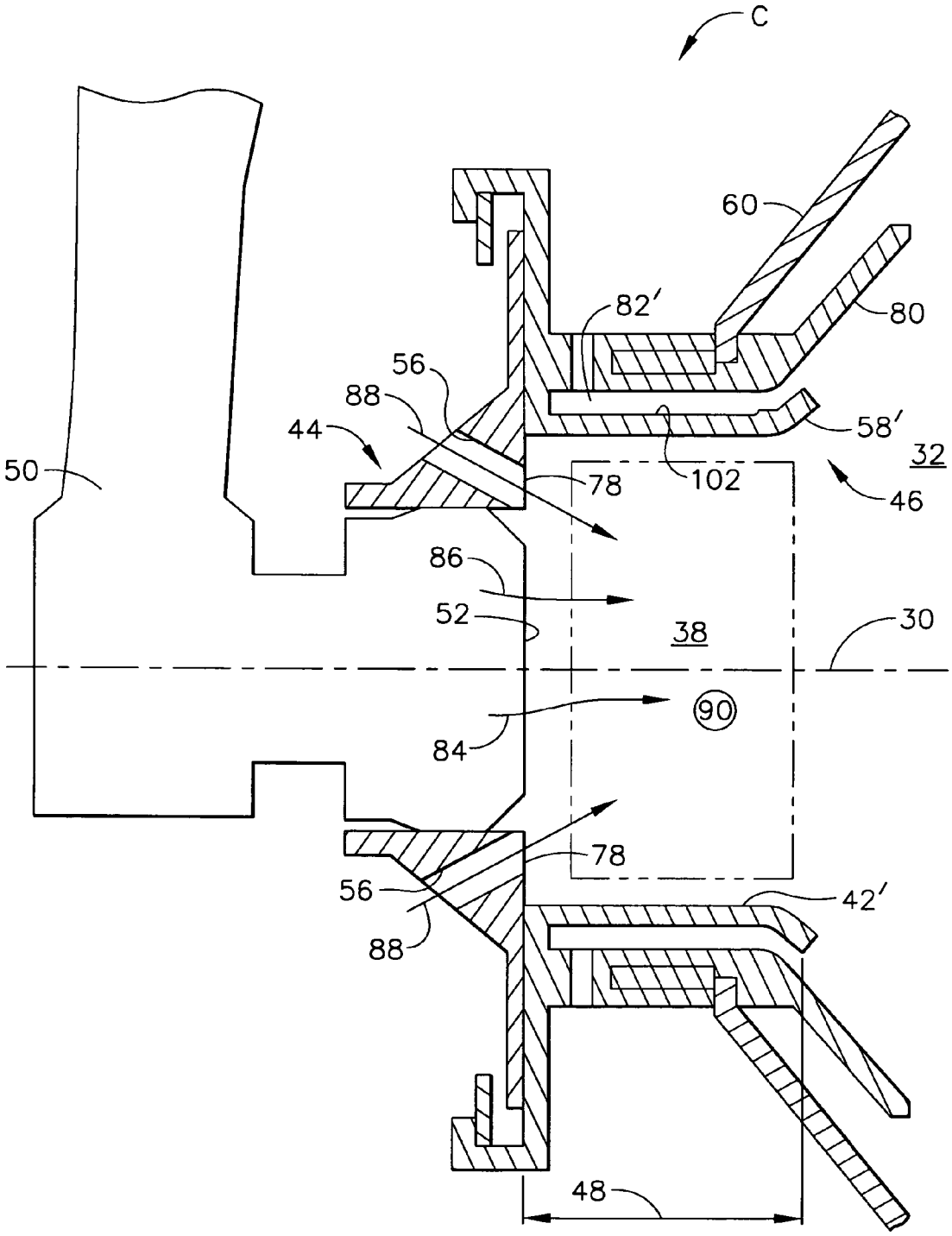
FIG. 4 is an enlarged view of portion C of FIG. 3.

In the embodiment shown in FIG. 3, and in the enlarged view of portion C of FIG. 3 shown in FIG. 4, nozzle face 52 may be aligned longitudinally, with at least a portion of at least one swirler passage outlet 78 of the plurality of swirler passages 56. The swirler passage outlets 78 may be defined by a first side 43 of the chamber inlet plate 41. Nozzle face 52 may be positioned such that fuel 84 and nozzle air 86 may be sprayed, atomized, or otherwise directed from nozzle face 52 into premix chamber 38, to produce a fuel air mixture 90. Premix chamber 38 may be roughly approximated by the dotted line rectangle shown in FIG. 3. In another embodiment, nozzle face 52 may be recessed relative to swirler passage outlets 78. Likewise, swirler passage outlets 78 may be disposed uniformly about combustor centerline 30, or may be non-uniformly disposed, both radially and longitudinally about combustor centerline 30. In the embodiment shown in FIGS. 3 and 4, premix chamber 38 may extend longitudinally from chamber inlet plate 41 to flair outlet opening 58, and radially between premix chamber wall 42 through combustor centerline 30 (similar to the embodiment shown in FIGS. 1 and 2). Flair outlet opening 58 of premix chamber 38 may also be separated from dome heat shield 80 by dome heat shield cooling passage 82.

In operation, nozzle air 86 and fuel 84 may be directed into premix chamber 38. Swirler air 88 may also enter premix chamber 38 through swirler passages 56. Fuel 84 may then be allowed to evaporate and mix with air within premix chamber 38 to produce a fuel air mixture 90 prior to fuel air mixture 90 being combusted within primary combustion chamber 32. Primary combustion of fuel air mixture 90 may produce a partial combustion mixture 92, which may be accelerated into necked down portion 62. Necked down portion 62 may have a decrease in radius that prevents hot gasses of partial combustion mixture 92 from recirculating upstream towards primary combustion chamber 32. Intermediate jets 68 may then provide a source of secondary combustion air 94 to secondary combustion chamber 66, such that unburned portions of fuel 84 within partial combustion mixture 92 may be combusted to produce exhaust gas 98. Next, dilution holes 70 may provide dilution air 96 to exhaust gas 98 to produce turbine gas 100 (i.e., exhaust gas at a temperature and pressure conducive to providing turbine power) which exits combustor 26 through combustor exit plane 72.

Figure 5:
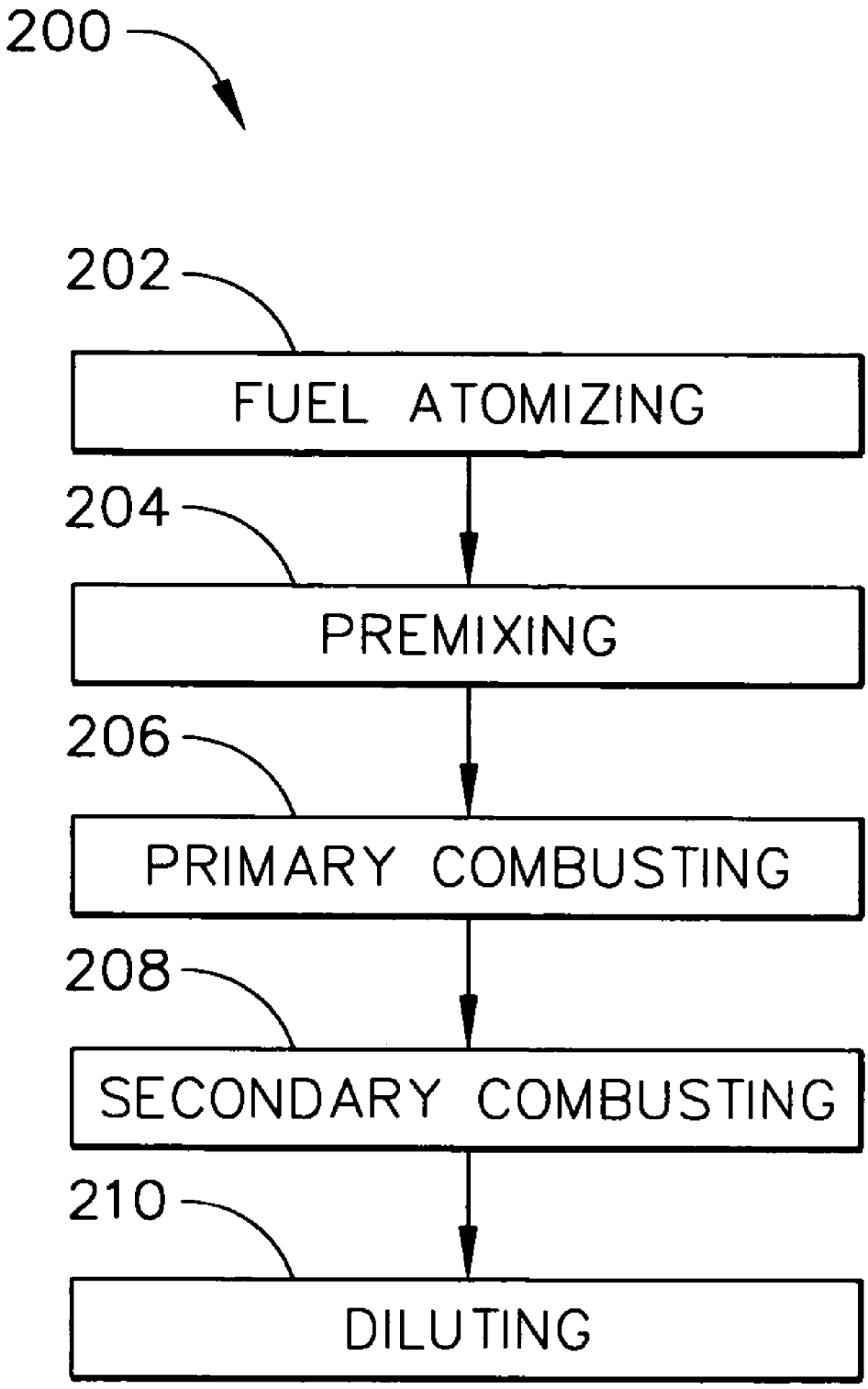
FIG. 5 is a flow chart representing steps of a method of producing turbine gas, according to another embodiment of the present invention.

As shown in the flow chart of FIG. 5, a method to produce turbine gas from a combustor 200 of the present invention may thus include a fuel atomizing step 202, wherein fuel 84 may be atomized and/or sprayed into premix chamber 38. Nozzle air 86 may also be directed into premix chamber 38. Swirler air 88 may also enter premix chamber 38 through swirler passages 56. Step 202 may be followed by a premixing step 204, wherein fuel 84 may be allowed to evaporate and mix with air within premix chamber 38 to produce fuel air mixture 90 prior to a primary combusting step 206, wherein fuel air mixture 90 may be combusted in primary combustion chamber 32, to produce partial combustion mixture 92.

After step 206, a secondary combusting step 208 may take place, wherein the partial combustion mixture 92 may be accelerated into necked down portion 62. Necked down portion 62 may have a decrease in radius that prevents hot gasses of partial combustion mixture 92 from recirculating upstream towards primary combustion chamber 32. Intermediate jets 68 may then provide a source of secondary combustion air 94 to secondary combustion chamber 66. As a result of secondary combusting step 208, unburned portions of fuel 84 within partial combustion mixture 92 may be combusted to produce exhaust gas 98. Next may follow a diluting step 210, wherein dilution holes 70 provide dilution air 96 to exhaust gas 98 to produce turbine gas 100, which exits combustor 26 through combustor exit plane 72.

In fuel atomization step 202, air fuel mixture 90 may be rich in fuel (i.e., have an excess amount of fuel over a stoichiometric amount of fuel required for combustion per volume of air present). In an embodiment, the fuel to air ratio (F/A ratio) within premix chamber 38 may be about 0.1214 to about 0.2481. Introduction of secondary combustion air 94 to partial combustion mixture 92 may change the stoichiometric ratio from rich to lean (i.e., having less than an amount of fuel with respect to a stoichiometric amount of fuel required for combustion per volume of air present). Accordingly, the temperature of exhaust gas 98 may be higher than that of partial combustion mixture 92, a condition which may be conducive to the formation of NOx. The size and spacing of dilution holes 70 may thus provide a quantity of dilution air 96 to exhaust gas 98, which may lower the temperature of exhaust gas 98 to a temperature consistent with turbine gas 100.

In an embodiment, the amount of air flow through premix chamber 34, may be about 11.5% to about 23.5% by volume of the total amount of air flow through combustor 26. Also, fuel air mixture 90 may have a residence time within premix chamber 38 of about 0.1 milliseconds (msec) to about 10 msec. In another embodiment, a residence time of fuel air mixture 90 in premix chamber 38 may be about 0.25 msec to about 2 msec. The volume of premix chamber 38 may be varied depending on the desired residence time. In an embodiment, the volume of premix chamber may be about 0.3 $in^3$ to about 1.4 $in^3$. In an alternative embodiment, the volume of premix chamber may be about 0.5 $in^3$ to about 1 $in^3$. In yet another embodiment, the volume of premix chamber may be about 0.6 $in^3$ to about 0.9 $in^3$.

It should be understood, of course, that the foregoing relates to exemplary embodiments of the invention and that modifications may be made without departing from the spirit and scope of the invention as set forth in the following claims.

We claim:

1. A combustor for a gas turbine engine, comprising:

a combustor inlet end longitudinally separated from a combustor outlet end along a combustor centerline;

a premix chamber disposed at said combustor inlet end, said premix chamber in fluid communication with a primary combustion chamber, said primary combustion chamber in fluid communication with a secondary combustion chamber disposed at said combustor outlet end, said premix chamber comprising a cylindrical chamber having a premix chamber wall coaxially disposed about said combustor centerline, said cylindrical chamber having a chamber inlet end longitudinally separated from a chamber outlet end along said combustor centerline by a chamber length;

a chamber inlet plate in communication with said premix chamber wall at said chamber inlet end;

a fuel nozzle inlet hole disposed through said chamber inlet plate; a plurality of swirler passages disposed through said chamber inlet plate; and a fuel nozzle engaged with said chamber inlet plate within said fuel nozzle inlet hole, said chamber outlet end comprising a flair outlet opening expanding radially away from said combustor centerline into said primary combustion chamber, said primary combustion chamber comprising a combustor liner having a first frustoconical portion attached to a cylindrical portion, said cylindrical portion attached to a second frustoconical portion serially disposed along said combustor central axis, wherein a radius of said first frustoconical portion increases in an axial direction from said combustor inlet end to said combustor outlet end, wherein a radius of said cylindrical portion remains constant longitudinally along said combustor centerline, wherein a radius of said second frustoconical portion decreases in an axial direction along said combustor centerline from said combustor inlet end to said combustor outlet end, said secondary combustor disposed within said combustor liner, wherein a radius of said secondary combustor remains constant in an axial direction, wherein said primary combustor comprises a frustoconical heat shield disposed between said first frustoconical portion and said combustor centerline, wherein said secondary combustor comprises a plurality of intermediate jets disposed through said combustor liner, wherein said secondary combustor comprises a plurality of dilution holes disposed through said combustor liner, and wherein said plurality of dilution holes are located between said intermediate jets and said combustor outlet end.

2. The combustor of claim 1, further comprising a frustoconical heat shield cooling passage disposed through, and arranged within, said chamber inlet plate such that an external environment is in fluid communication with said frustoconical heat shield through a conduit between said premix chamber wall and said frustoconical heat shield.

3. The combustor of claim 1, wherein said chamber length is about 0.2 inches to about 1 inch.

4. The combustor of claim 1, wherein said chamber length is about 0.4 inches to about 0.7 inches.

5. The combustor of claim 1, wherein said chamber length is about 0.5 inches to about 0.6 inches.

6. The combustar of claim 1, wherein a ratio of said chamber length to a chamber diameter is about 0.2 to about 0.6.

7. The gas turbine combustor of claim 1, wherein a volume of said premix chamber is about 0.3 $in^3$ to about 1.4 $in^3$.

8. The gas turbine combustor of claim 1, wherein a volume of said premix chamber is about 0.5 $in^3$ to about 1 $in^3$.

9. A gas turbine engine comprising:

a compressor in operable communication with a combustor module, said combustor module in operable communication with a turbine module, said combustor module comprising a combustor inlet end longitudinally separated from a combustor outlet end along a combustor centerline, a premix chamber disposed at said combustor inlet end, said premix chamber in fluid communication with a primary combustion chamber, said primary combustion chamber in fluid communication with a secondary combustion chamber disposed at said combustor outlet end, said premix chamber comprising a cylindrical chamber having a premix chamber wall disposed about said combustor centerline, said cylindrical chamber having a chamber inlet end longitudinally separated from a chamber outlet end along said combustor centerline, said chamber inlet end comprising a chamber inlet plate in communication with said premix chamber wall, said chamber inlet plate having a fuel nozzle inlet hole disposed through said chamber inlet plate, said chamber inlet plate further comprising a plurality of swirler passages disposed through said chamber inlet plate, a fuel nozzle engaged with said chamber inlet plate within said fuel nozzle inlet hole, and said chamber outlet end being open.

10. A gas turbine engine comprising:

a compressor in operable communication with a combustor module, said combustor module in operable communication with a turbine module, said combustor module comprising a combustor inlet end longitudinally separated from a combustor outlet end along a combustor centerline, a premix chamber disposed at said combustor inlet end, said premix chamber in fluid communication with a primary combustion chamber, said primary combustion chamber in fluid communication with a secondary combustion chamber disposed at said combustor outlet end, said premix chamber comprising a cylindrical chamber having a premix chamber wall disposed about said combustor centerline, said cylindrical chamber having a chamber inlet end longitudinally separated from a chamber outlet end along said combustor centerline, said chamber inlet end comprising a chamber inlet plate in communication with said premix chamber wall, said chamber inlet plate having a fuel nozzle inlet hole disposed through said chamber inlet plate, said chamber inlet plate further comprising a plurality of swirler passages disposed through said chamber inlet plate, a fuel nozzle engaged with said chamber inlet plate within said fuel nozzle inlet hole, and said chamber outlet end comprising a flair outlet opening expanding radially away from said combustor centerline into said primary combustion chamber.

11. The gas turbine engine of claim 10, wherein each of said plurality of swirler passages comprise a cantilever portion disposed within said chamber inlet plate at a cantilever angle of about 25° to about 45° to a line perpendicular to said combustor centerline.

12. A method for producing turbine gas from a combustor, comprising the steps of:

a) atomizing a fuel into a premix chamber of said combustor, b) premixing said fuel with a quantity of air, wherein said fuel and said air are mixed within said premix chamber for a residence time to produce an air fuel mixture, c) performing a primary combusting step, wherein said air fuel mixture is combusted in a primary combustion chamber of said combustor to produce a partial combustion mixture, d) performing a secondary combusting step, wherein said partial combustion mixture is directed through a necked down portion of said primary combustion chamber into a secondary combustion chamber, wherein a plurality of intermediate jets provide secondary combustion air to produce exhaust gas, followed by:

e) diluting said exhaust gas, wherein dilution holes disposed through said secondary combustor provide dilution air, wherein said exhaust gas is diluted with said dilution air to produce turbine gas.

13. The method of claim 12, wherein said residence time is about 0.1 to about 10 milliseconds.

14. The method of claim 12, wherein a fuel to air ratio of said fuel air mixture is about 0.1214 to about 0.2481.

15. The method of claim 12, wherein an amount of air flow through said premix chamber is about 11.5% to about 23.5% of a total air flow through said combustor.

* * * * *